US011229567B2

(12) United States Patent
Veloz

(10) Patent No.: US 11,229,567 B2
(45) Date of Patent: Jan. 25, 2022

(54) TRANSFER SEATING ASSEMBLY

(71) Applicant: Manuel Veloz, Victorville, CA (US)

(72) Inventor: Manuel Veloz, Victorville, CA (US)

( * ) Notice: Subject to any disclaimer, the term of this patent is extended or adjusted under 35 U.S.C. 154(b) by 0 days.

(21) Appl. No.: 16/892,659

(22) Filed: Jun. 4, 2020

(65) Prior Publication Data

US 2021/0378897 A1 Dec. 9, 2021

(51) Int. Cl.

| | |
|---|---|
| ***A61G 7/10*** | (2006.01) |
| ***A47K 3/12*** | (2006.01) |
| ***A47K 3/28*** | (2006.01) |

(52) U.S. Cl.

CPC ..... *A61G 7/1003* (2013.01); *A47K 3/122* (2013.01); *A47K 3/282* (2013.01); *A61G 7/1059* (2013.01)

(58) Field of Classification Search

CPC .... A61G 7/1003; A61G 7/1059; A47K 3/122; A47K 3/282

See application file for complete search history.

(56) References Cited

U.S. PATENT DOCUMENTS

| | | | | |
|---|---|---|---|---|
| 5,517,704 | A | 5/1996 | Dagostino | |
| D389,099 | S | 1/1998 | McKay | |
| 5,822,809 | A | 10/1998 | Gallo | |
| 6,240,577 | B1 | 6/2001 | Worthy | |
| 6,681,415 | B1 | 1/2004 | Gallo | |
| 6,842,919 | B2 | 1/2005 | Wilson | |
| 8,181,285 | B1 * | 5/2012 | Jackson | A47K 3/122 4/578.1 |
| 9,107,787 | B2 * | 8/2015 | Wechter | A47K 3/122 |
| 9,468,573 | B2 * | 10/2016 | Edwards | A61G 7/1003 |
| 2008/0052814 | A1 | 3/2008 | Kaiwai | |
| 2011/0239364 | A1 | 10/2011 | Goldstein | |
| 2011/0283449 | A1 | 11/2011 | Baxley | |
| 2018/0049934 | A1 * | 2/2018 | Lucas | A61G 7/1046 |

* cited by examiner

*Primary Examiner* — Janie M Loeppke

(57) ABSTRACT

A transfer seating assembly for facilitating transitioning of a user to a shower enclosure or tub includes a plate, a plurality of legs, and a seat. The legs are engaged to and extend substantially perpendicularly from a bottom of the plate. Each leg comprises a plurality of nested sections so that the leg is selectively extensible. The legs can be selectively extended to position the plate in a substantially horizontal position and at a desired height. The seat is rotationally and slidably engaged to a top of the plate and can be selectively and fixedly engaged to the plate. A user positioned in the seat can selectively slide the seat, and the user, from proximate to a first end to proximate to a second end of the plate. The user also is positioned to rotate the seat, and the user, relative to the plate.

15 Claims, 6 Drawing Sheets

TRANSFER SEATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to transfer assembly and more particularly pertains to a new transfer assembly for facilitating transitioning of a user to a shower enclosure or tub.

(2) Description of Related Art Including Information Disclosed Under 37 CFR 1.97 and 1.98

The prior art relates to transfer assemblies. Prior art transfer assemblies may comprise a slidable platform, assemblies to transfer from a position over a toilet to a tub or shower enclosure, assemblies having only simultaneous seat rotation and sliding, and seat slides that engage a tub wall.

BRIEF SUMMARY OF THE INVENTION

An embodiment of the disclosure meets the needs presented above by generally comprising a plate, a plurality of legs, and a seat. The legs are engaged to and extend substantially perpendicularly from a bottom of the plate. Each leg comprises a plurality of nested sections so that the leg is selectively extensible. The legs are configured to be selectively extended to position the plate in a substantially horizontal position and at a desired height. The seat is rotationally and slidably engaged to a top of the plate and is configured to selectively and fixedly engage the plate. The seat is configured to seat a user, thereby positioning the user to selectively slide the seat, and the user, from proximate to a first end to proximate to a second end of the plate. The user also is positioned to rotate the seat, and the user, relative to the plate. The assembly is useful in transferring the user into and out of a bathtub or a shower enclosure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
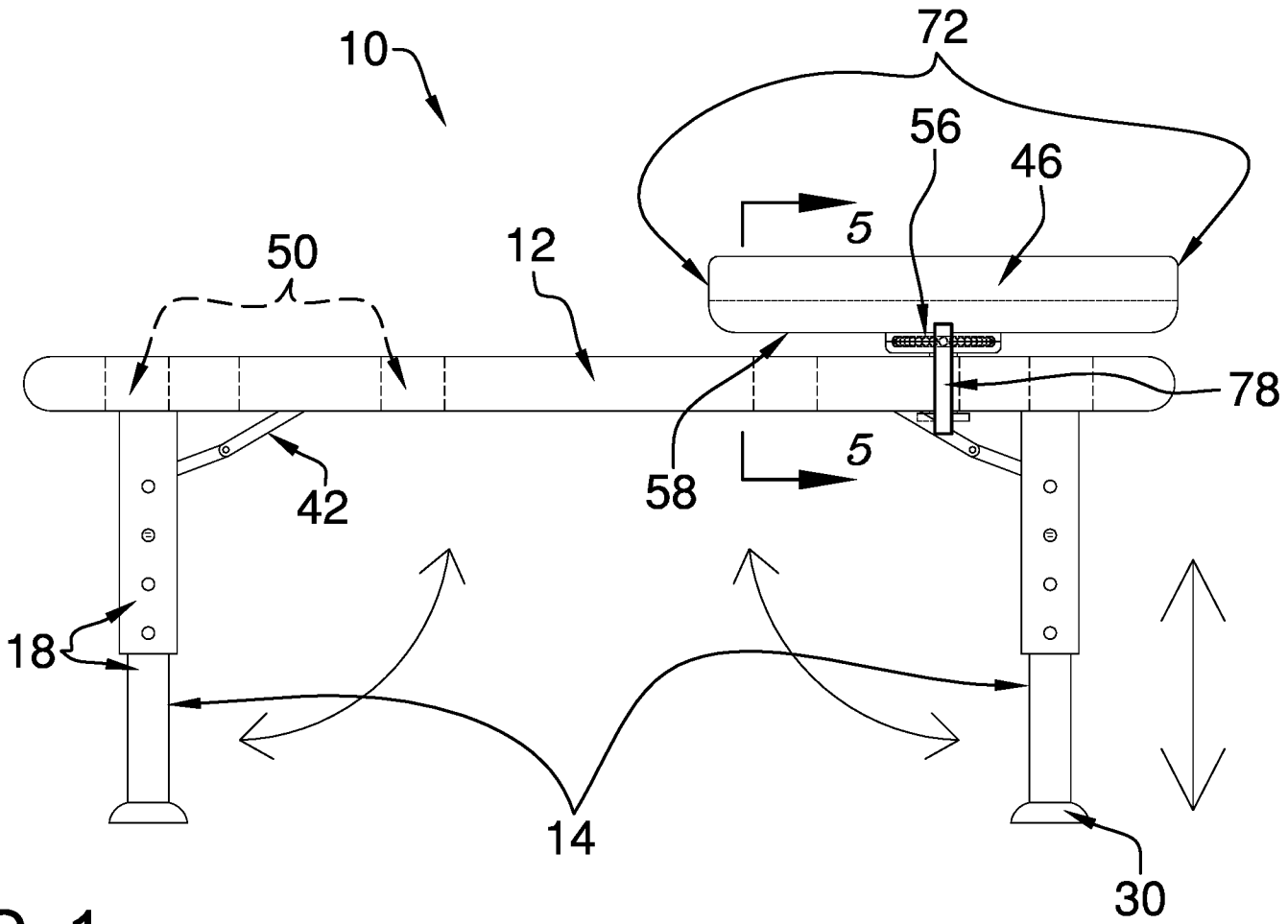
FIG. 1 is a front view of a transfer seating assembly according to an embodiment of the disclosure.

With reference now to the drawings, and in particular to FIGS. 1 through 7 thereof, a new transfer assembly embodying the principles and concepts of an embodiment of the disclosure and generally designated by the reference numeral 10 will be described.

Figure 2:
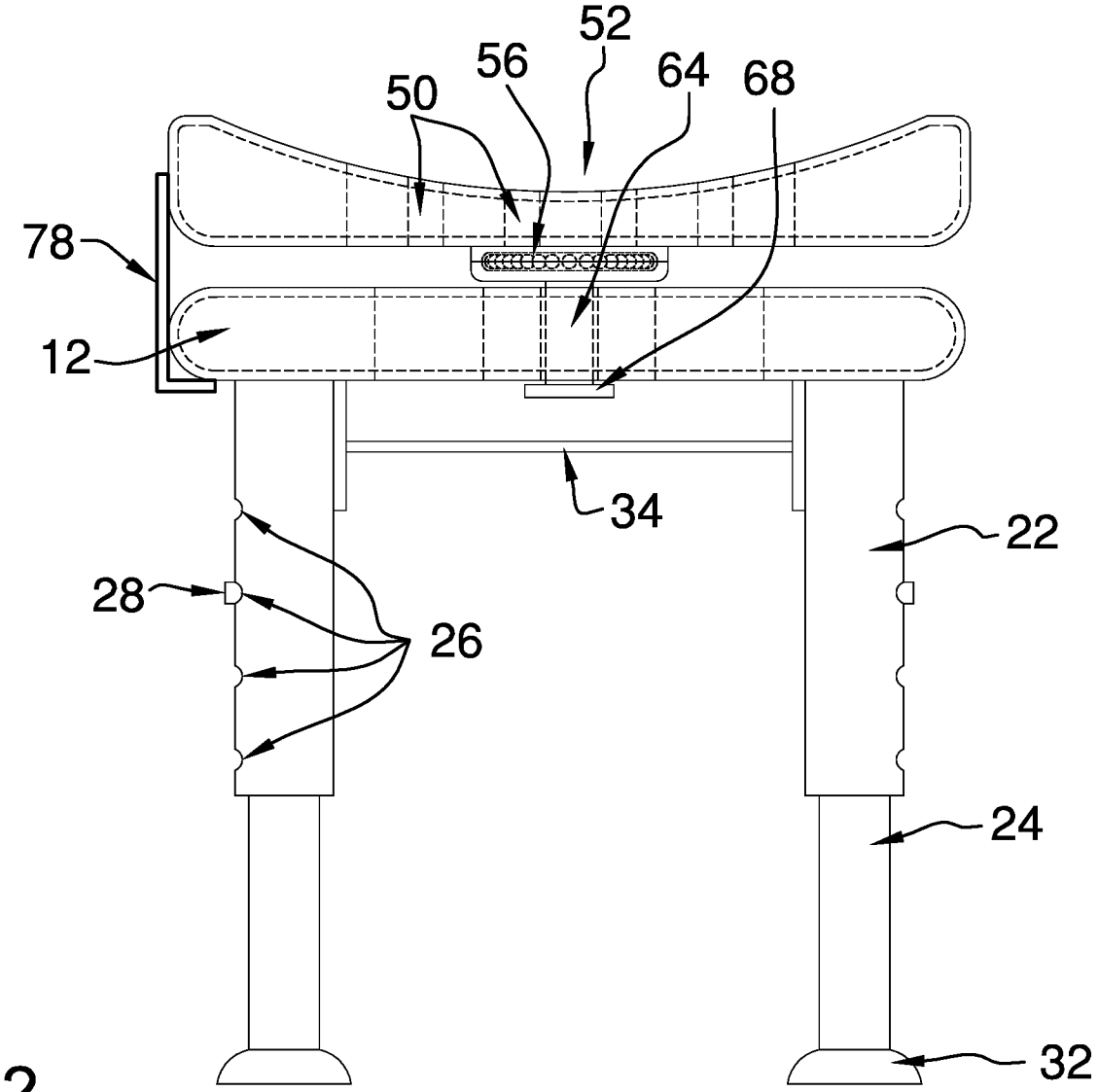
FIG. 2 is an end view of an embodiment of the disclosure.
Figure 3:
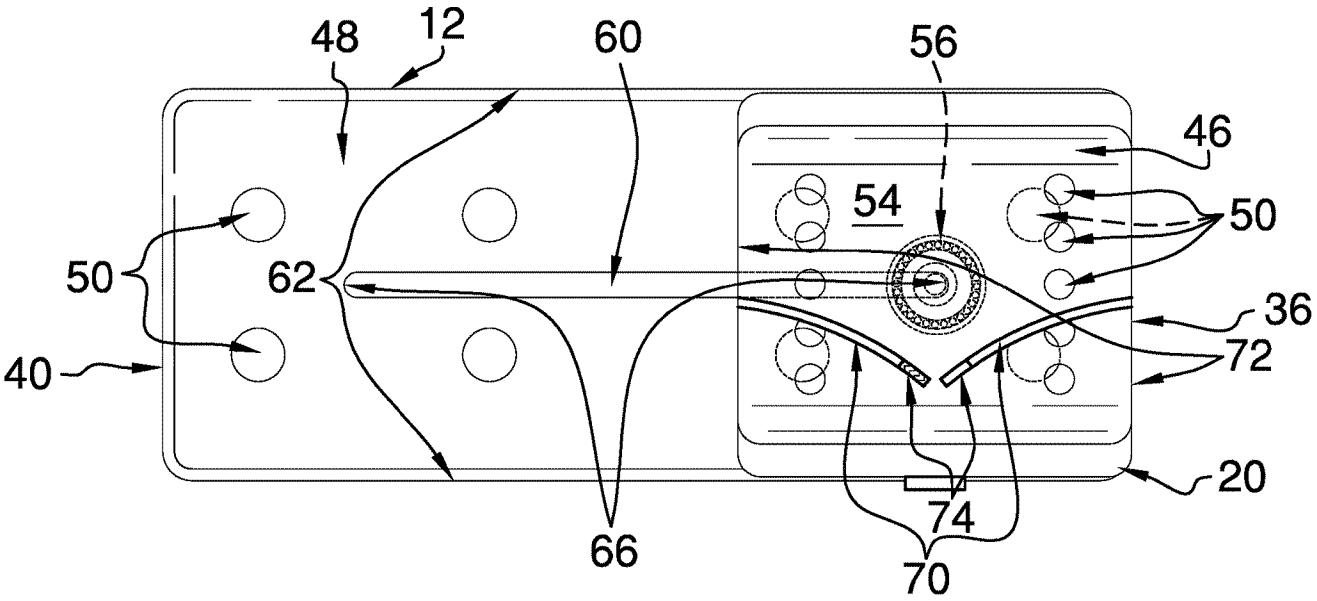
FIG. 3 is a top view of an embodiment of the disclosure.
Figure 4:
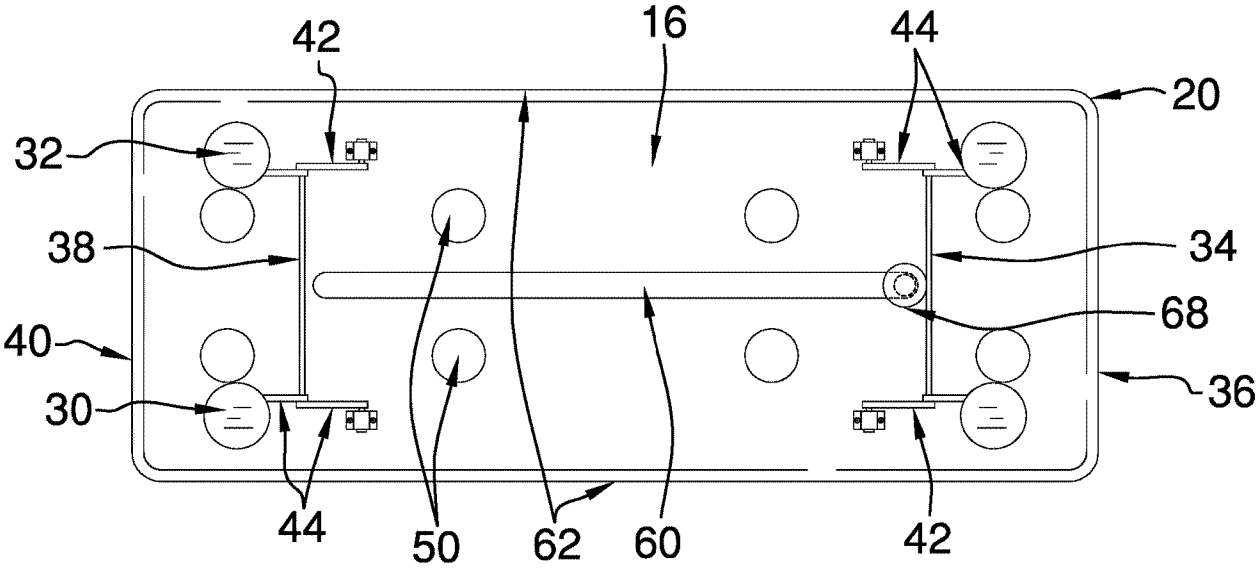
FIG. 4 is a bottom view of an embodiment of the disclosure.

As best illustrated in FIGS. 1 through 7, the transfer seating assembly 10 generally comprises a plate 12, a plurality of legs 14, and a seat 46. The legs 14 are engaged to and extend substantially perpendicularly from a bottom 16 of the plate 12. Each leg 14 comprises a plurality of nested sections 18 so that the leg 14 is selectively extensible. The legs 14 are configured to be selectively extended to position the plate 12 in a substantially horizontal position and at a desired height. The plurality of legs 14 comprises four legs 14 positioned singly proximate to each corner 20 of the plate 12, as shown in FIG. 4.

The plurality of nested sections 18 comprises an upper section 22 and a lower section 24, as shown in FIG. 2. The upper section 22 has a plurality of apertures 26 positioned therein. The lower section 24 has a pin 28 engaged thereto. The pin 28 is spring loaded and is configured to be depressed to allow adjustment of the lower section 24 relative to the upper section 22. The pin 28 is positioned to extend into a respective aperture 26 to fixedly position the lower section 24 relative to the upper section 22.

The legs 14 are hingedly engaged to the plate 12 so that the legs 14 are selectively positionable in a deployed configuration, as shown in FIG. 1, and a stowed configuration (not shown). In the deployed configuration, the legs 14 are substantially perpendicular to the plate 12. In the stowed configuration, the legs 14 are positioned in substantial abutment to the bottom 16 of the plate 12.

Each leg 14 has a foot 30 engaged thereto distal from the plate 12 so that the foot 30 is positioned between the leg 14 and a surface, such as a floor, tub, or shower enclosure base. The feet 30 are configured to stabilize the plate 12 in the substantially horizontal position. The foot 30 may comprise a cup 32, which is resilient compressible. The cup 32 is configured to be depressed between the respective leg 14 and the surface to suctionally engage the respective leg 14 to the surface. The cup 32 comprises at least one of rubber, silicone, and elastomer.

Figure 7:
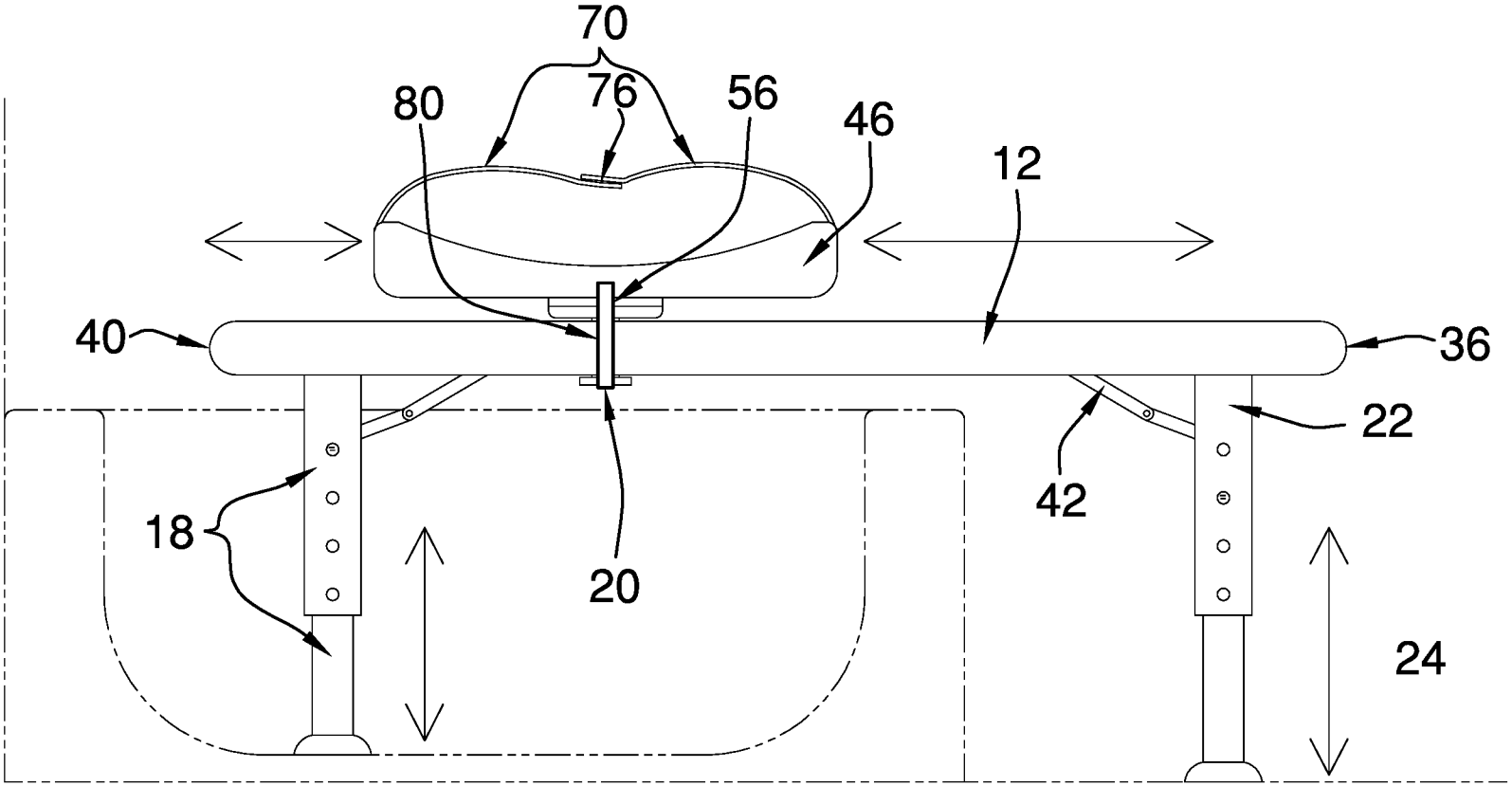
FIG. 7 is a front in-use view of an embodiment of the disclosure.

Each leg 14 has a brace 42 hingedly engaged thereto, as shown in FIG. 4. The brace 42 also is hingedly engaged to the bottom 16 of the plate 12. The brace 42 comprises a pair of segments 44, which are pivotally engaged so that the segments 44 are selectively positionable in an extended configuration and a folded configuration. In the extended configuration, the segments 44 extend substantially linearly between the leg 14 and the plate 12, as shown in FIG. 7. In the folded configuration (not shown), the segments 44 are substantially overlaid. The segments 44 are selectively mutually couplable when positioned in the extended configuration to stabilize the leg 14 perpendicularly relative to the plate 12.

A first crossbar 34 is coupled to and extends between the braces 42 connected to the legs 14 positioned proximate to a first end 36 of the plate 12, as shown in FIG. 2. The first crossbar 34 is configured to retain the legs 14 positioned proximate to the first end 36 of the plate 12 in parallel. A second crossbar 38 is coupled to and extends between the braces 42 connected to the legs 14 positioned proximate to a second end 40 of the plate 12. The second crossbar 38 is configured to retain the legs 14 positioned proximate to the second end 40 of the plate 12 in parallel.

Figure 6:
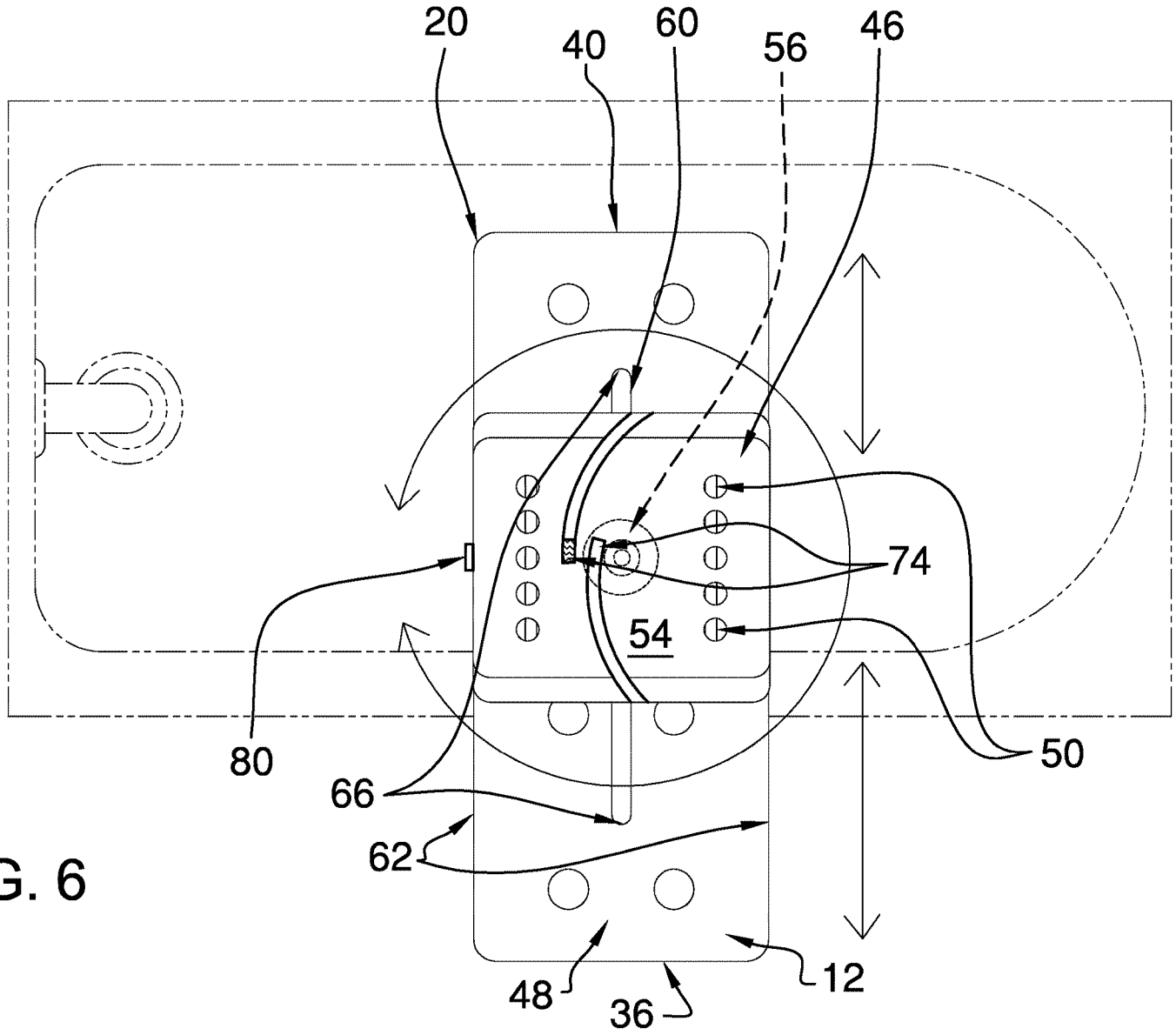
FIG. 6 is a top in-use view of an embodiment of the disclosure.

The seat 46 is rotationally and slidably engaged to a top 48 of the plate 12 and is configured to selectively and fixedly engage the plate 12. The seat 46 is configured to seat a user, thereby positioning the user to selectively slide the seat 46, and the user, from proximate to the first end 36 to proximate to the second end 40 of the plate 12, as shown in FIG. 7. The user also is positioned to rotate the seat 46, and the user, relative to the plate 12, as shown in FIG. 6. The assembly 10 is useful in transferring the user into and out of a bathtub or a shower enclosure.

The seat 46 and the plate 12 have a plurality of holes 50 positioned therein, as shown in FIGS. 3 and 4. The holes 50 are configured to allow drainage of water from the seat 46 and the plate 12. The seat 46 has a depression 52 positioned in an upper surface 54 thereof. The depression 52 is arcuate, as shown in FIG. 5, to provide comfort to the user positioned thereupon.

Figure 5:
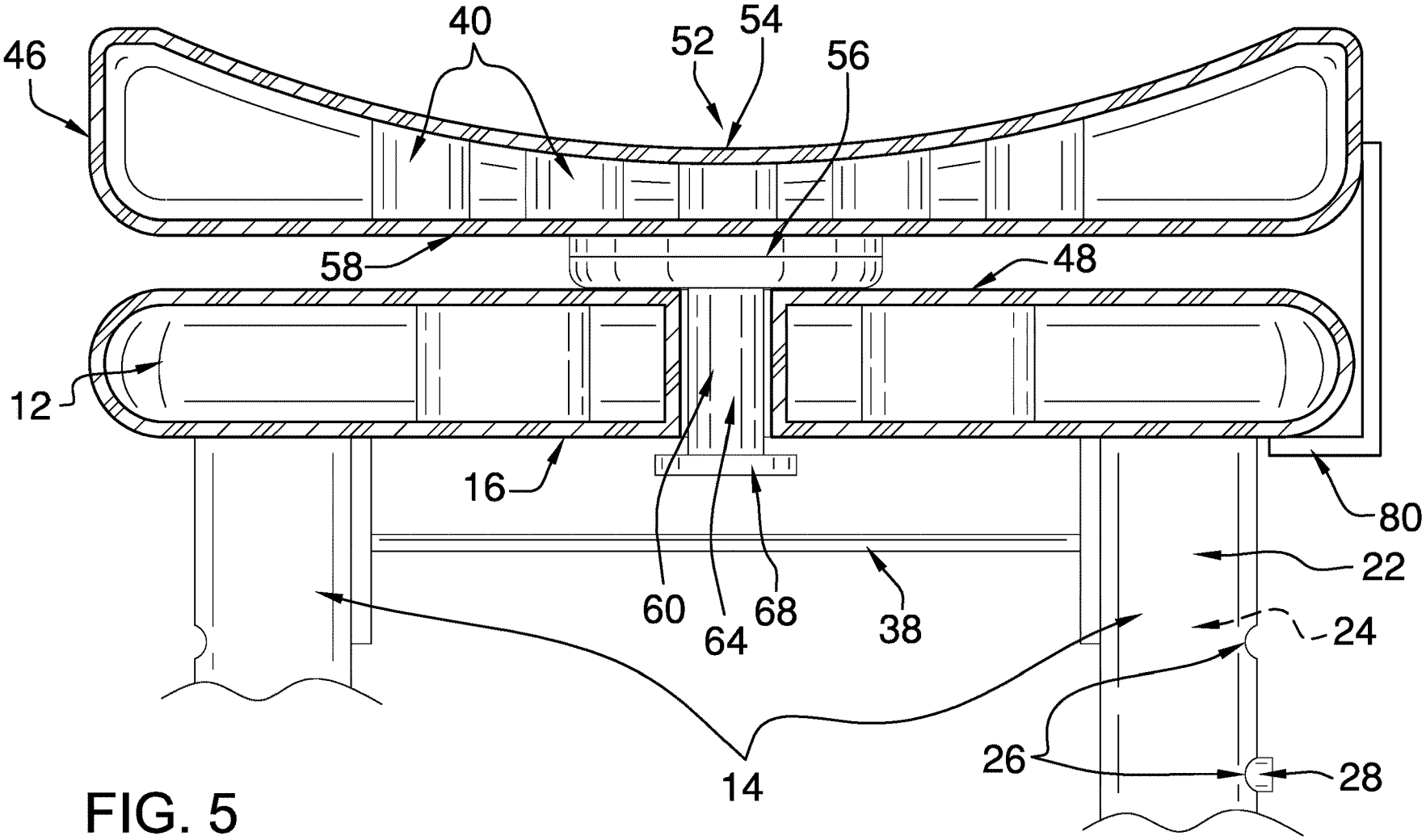
FIG. 5 is a cross-sectional view of an embodiment of the disclosure.

A swivel bearing 56 is engaged to a lower surface 58 of the seat 46 and is slidably engaged to the top 48 of the plate 12, as shown in FIG. 5. The swivel bearing 56 is configured to allow rotation of the seat 46 relative to the plate 12. The plate 12 has a slot 60 positioned therein, which extends from proximate to the first end 36 to proximate to the second end 40 of the plate 12 and is positioned substantially equally distant from and parallel to opposed sides 62 of the plate 12. A rod 64 is coupled to the swivel bearing 56 and extends through the slot 60. The rod 64 is positioned to limit sliding of the seat 46 by contacting of the rod 64 with opposed limits 66 of the slot 60. The rod 64 also is positioned to retain the seat 46 substantially equally distant from the opposed sides 62 of the plate 12. A disc 68 is coupled to the rod 64 distal from the swivel bearing 56 and is positioned proximate to the bottom 16 of the plate 12. The rod 64 and the disc 68 thus engage the seat 46 to the plate 12.

Each of a pair of straps 70 is coupled to and extends from a respective opposing side 72 of the seat 46. Each of a pair of fasteners 74 is engaged to a respective strap 70 distal from the seat 46. The fasteners 74 are selectively mutually couplable. The pair of straps 70 is configured to be positioned over thighs of the user seated upon the seat 46. The user then is positioned to engage the fasteners 74 to secure the straps 70 over the thighs, and the user to the seat 46. The pair of fasteners 74 may comprise a hook and loop fastener 76, as shown in FIG. 3, or other fastening means, such as, but not limited to, seatbelt latches, side release buckles, and the like.

A connector 78 is engaged to the seat 46 and is configured to selectively engage the plate 12. The connector 78 is positioned to selectively engage the plate 12 to prevent rotation and sliding of the seat 46 relative to the plate 12. The connector 78 may comprise a latch 80, as shown in FIG. 1, or other connecting means, such as, but not limited to, brakes, locking pins, and the like.

In use, legs 14 positioned near the second end 40 of the plate 12 are positioned in the tub or shower enclosure and are adjusted to a desired height. The legs 14 positioned near the first end 36 of the plate 12 are positioned outside of the tub or shower enclosure and are adjusted to level the plate 12. The user then can be seated and strapped to the seat 46. The seat 46 allows the user to slide into, and out of, the tub or shower enclosure and to rotate relative to the plate 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A transfer seating assembly comprising:

a plate;

a plurality of legs engaged to and extending substantially perpendicularly from a bottom of the plate, each leg comprising a plurality of nested sections such that the leg is selectively extensible, wherein the legs are configured for selectively extending for positioning the plate in a substantially horizontal position at a desired height;

a seat rotationally and slidably engaged to a top of the plate and being configured for selectively fixedly engaging the plate, wherein the seat is configured for seating of a user, positioning the user for selectively sliding the seat and the user from proximate to a first end to proximate to a second end of the plate, and for rotating the seat and the user relative to the plate, the seat having an upper surface, the upper surface having a pair of outer strip portions and a curved medial portion extending between and parallel to the outer strip portions wherein opposing sides of the seat along the outer strip portions are offset from the curved medial portion;

a pair of straps, each strap being coupled to and extending from a respective ones of the opposing sides of the seat such that the straps are coupled to the seat offset from the curved medial portion of the upper surface of the seat; and a pair of fasteners, each fastener being engaged to a respective strap distal from the seat, the fasteners being selectively mutually couplable, wherein the pair of straps is configured for positioning over thighs of the user seated upon the seat, positioning the user for engaging the fasteners for securing the straps over the thighs, and the user to the seat.

2. The transfer seating assembly of claim 1, wherein the plurality of nested sections comprises an upper section and a lower section, the upper section having a plurality of apertures positioned therein, the lower section having a pin engaged thereto, the pin being spring loaded, wherein the pin is configured for depressing for allowing adjustment of the lower section relative to the upper section, and such that the pin is positioned for extending into a respective aperture for fixedly positioning the lower section relative to the upper section.

3. The transfer seating assembly of claim 1, further comprising:

the plate having four corners; and the plurality of legs comprising four legs positioned singly proximate to each corner of the plate.

4. The transfer seating assembly of claim 3, wherein the legs are hingedly engaged to the plate such that the legs are selectively positionable in a deployed configuration, wherein the legs are substantially perpendicular to the plate, and a stowed configuration, wherein the legs are positioned in substantial abutment to the bottom of the plate.

5. The transfer seating assembly of claim 1, further including each leg having a foot engaged thereto distal from the plate, such that the foot is positioned between the leg and a surface, wherein the feet are configured for stabilizing the plate in the substantially horizontal position.

6. The transfer seating assembly of claim 5, wherein the foot comprises a cup, the cup being resilient compressible, wherein the cup is configured for depressing between the respective leg and the surface for suctionally engaging the respective leg to the surface.

7. The transfer seating assembly of claim 6, wherein the cup comprising at least one of rubber, silicone, and elastomer.

8. The transfer seating assembly of claim 4, further including each leg having a brace hingedly engaged thereto, the brace being hingedly engaged to the bottom of the plate, the brace comprising a pair of segments, the segments being pivotally engaged, such that the segments are selectively positionable in an extended configuration, wherein the segments extend substantially linearly between the leg and the plate, and a folded configuration, wherein the segment are substantially overlaid, the segments being selectively mutually couplable when positioned in the extended configuration for stabilizing the leg perpendicularly relative to the plate.

9. The transfer seating assembly of claim 8, further including:

a first crossbar coupled to and extending between the braces connected to the legs positioned proximate to the first end of the plate, such that the first crossbar is configured for retaining the legs positioned proximate to the first end of the plate in parallel; and a second crossbar coupled to and extending between the braces connected to the legs positioned proximate to the second end of the plate, such that the second crossbar is configured for retaining the legs positioned proximate to the second end of the plate in parallel.

10. The transfer seating assembly of claim 1, wherein the seat and the plate have a plurality of holes positioned therein, wherein the holes are configured for draining of water from the seat and the plate.

11. The transfer seating assembly of claim 1, wherein the curved medial portion of the upper surface of the seat defines a depression positioned in the upper surface thereof, the depression being arcuate.

12. The transfer seating assembly of claim 1, further including a swivel bearing engaged to a lower surface of the seat and slidably engaged to the top of the plate, wherein the swivel bearing is configured for allowing rotation of the seat relative to the plate.

13. The transfer seating assembly of claim 12, further including:

the plate having a slot positioned therein, the slot extending from proximate to the first end to proximate to the second end thereof and being positioned substantially equally distant from and parallel to opposed sides thereof;

a rod coupled to the swivel bearing and extending through the slot, such that the rod is positioned for limiting sliding of the seat by contacting of the rod with opposed limits of the slot, and such that the rod is positioned for retaining the seat substantially equally distant from the opposed sides of the plate; and a disc coupled to the rod distal from the swivel bearing and being positioned proximate to the bottom of the plate, such that the rod and the disc engage the seat to the plate.

14. The transfer seating assembly of claim 1, further including a connector engaged to the seat and being configured for selectively engaging the plate, such that the connector is positioned for selectively engaging the plate for preventing rotation and sliding of the seat relative to the plate.

15. A transfer seating assembly comprising:

a plate having a slot positioned therein, the slot extending from proximate to a first end to proximate to a second end thereof and being positioned substantially equally distant from and parallel to opposed sides thereof, the plate having four corners;

a plurality of legs engaged to and extending substantially perpendicularly from a bottom of the plate, each leg comprising a plurality of nested sections such that the leg is selectively extensible, wherein the legs are configured for selectively extending for positioning the plate in a substantially horizontal position at a desired height, the plurality of nested sections comprising an upper section and a lower section, the upper section having a plurality of apertures positioned therein, the lower section having a pin engaged thereto, the pin being spring loaded, wherein the pin is configured for depressing for allowing adjustment of the lower section relative to the upper section, and such that the pin is positioned for extending into a respective aperture for fixedly positioning the lower section relative to the upper section, the plurality of legs comprising four legs positioned singly proximate to each corner of the plate, the legs being hingedly engaged to the plate such that the legs are selectively positionable in a deployed configuration, wherein the legs are substantially perpendicular to the plate, and a stowed configuration, wherein the legs are positioned in substantial abutment to the bottom of the plate;

each leg having a foot engaged thereto distal from the plate, such that the foot is positioned between the leg and a surface, wherein the feet are configured for stabilizing the plate in the substantially horizontal position, the foot comprising a cup, the cup being resilient compressible, wherein the cup is configured for depressing between the respective leg and the surface for suctionally engaging the respective leg to the surface, the cup comprising at least one of rubber, silicone, and elastomer;

each leg having a brace hingedly engaged thereto, the brace being hingedly engaged to the bottom of the plate, the brace comprising a pair of segments, the segments being pivotally engaged, such that the segments are selectively positionable in an extended configuration, wherein the segments extend substantially linearly between the leg and the plate, and a folded configuration, wherein the segment are substantially overlaid, the segments being selectively mutually couplable when positioned in the extended configuration for stabilizing the leg perpendicularly relative to the plate;

a first crossbar coupled to and extending between the braces connected to the legs positioned proximate to the first end of the plate, such that the first crossbar is configured for retaining the legs positioned proximate to the first end of the plate in parallel;

a second crossbar coupled to and extending between the braces connected to the legs positioned proximate to the second end of the plate, such that the second crossbar is configured for retaining the legs positioned proximate to the second end of the plate in parallel;

a seat rotationally and slidably engaged to a top of the plate and being configured for selectively fixedly engaging the plate, wherein the seat is configured for seating of a user, positioning the user for selectively sliding the seat and the user from proximate to the first end to proximate to the second end of the plate, and for rotating the seat and the user relative to the plate, the seat and the plate having a plurality of holes positioned therein, wherein the holes are configured for draining of water from the seat and the plate, the seat having an upper surface, the upper surface having a pair of outer strip portions and a curved medial portion extending between and parallel to the outer strip portions wherein opposing sides of the seat along the outer strip portions are offset from the curved medial portion, the curved medial portion defining a depression positioned in the upper surface of the seat;

a swivel bearing engaged to a lower surface of the seat and slidably engaged to the top of the plate, wherein the swivel bearing is configured for allowing rotation of the seat relative to the plate;

a rod coupled to the swivel bearing and extending through the slot, such that the rod is positioned for limiting sliding of the seat by contacting of the rod with opposed limits of the slot, and such that the rod is positioned for retaining the seat substantially equally distant from the opposed sides of the plate;

a disc coupled to the rod distal from the swivel bearing and being positioned proximate to the bottom of the plate, such that the rod and the disc engage the seat to the plate;

a pair of straps, each strap being coupled to and extending from a respective one of the opposing sides of the seat such that the straps are coupled to the seat offset from the curved medial portion of the upper surface of the seat;

a pair of fasteners, each fastener being engaged to a respective strap distal from the seat, the fasteners being selectively mutually couplable, wherein the pair of straps is configured for positioning over thighs of the user seated upon the seat, positioning the user for engaging the fasteners for securing the straps over the thighs, and the user to the seat; and a connector engaged to the seat and being configured for selectively engaging the plate, such that the connector is positioned for selectively engaging the plate for preventing rotation and sliding of the seat relative to the plate.

* * * * *